US005267512A

United States Patent [19]

Miyoshi et al.

[11] Patent Number: 5,267,512

[45] Date of Patent: Dec. 7, 1993

[54] BLANKET TO BLANKET TYPE PRINTING PRESS EMPLOYING DIVIDED PLATE CYLINDER

[75] Inventors: Masahiko Miyoshi, Ayase; Kiyohisa Asanuma, Kawasaki; Kazuharu Soutome, Zama, all of Japan

[73] Assignee: Kabushiki Kaisha Tokyo Kikai Seisakusho, Tokyo, Japan

[21] Appl. No.: 890,551

[22] Filed: May 28, 1992

[30] Foreign Application Priority Data

Nov. 16, 1991 [JP] Japan ..... 3-354122

[51] Int. Cl.[5] ..... B41F 5/00

[52] U.S. Cl. ..... 101/216; 101/178; 101/248; 101/219

[58] Field of Search ..... 101/177, 178, 179, 180, 101/181, 183, 184, 185, 216, 217, 218, 219, 220, 221, 248

[56] References Cited

U.S. PATENT DOCUMENTS

| | | | |
|---|---|---|---|
| 2,003,800 | 5/1935 | Barber | 101/171 |
| 3,196,788 | 7/1965 | Knowles | 101/217 |
| 3,732,815 | 5/1973 | Greiner et al. | 101/220 |
| 3,742,849 | 7/1973 | Greiner et al. | 101/220 |
| 4,072,104 | 2/1978 | Schaffer | 101/248 |
| 4,207,815 | 6/1980 | Watanabe | 101/248 |
| 4,350,093 | 9/1982 | Ishii | 101/217 |
| 4,651,641 | 3/1987 | Kawata et al. | 101/217 |

FOREIGN PATENT DOCUMENTS 61-182951 8/1986 Japan .

*Primary Examiner*—Edgar S. Burr
*Assistant Examiner*—Christopher A. Bennett
*Attorney, Agent, or Firm*—Trexler, Bushnell, Giangiorgi & Blackstone, Ltd.

[57] ABSTRACT

A BB-type printing press employing a divided plate cylinder has a novel drive gear train for avoiding rotation in the associated rotating condition and whereby to maintain satisfactory level of sharpness and/or clearness of printed patterns. The BB-type printing press comprises a pair of plate cylinders respectively carrying printing plates, each of the plate cylinders being separated into axially aligned a first plate cylinder component and a second plate cylinder component for rotation at independently adjustable rotational phases, a pair of blanket cylinders respectively carrying blankets and associated with the plate cylinders for receiving printing pattern of the printing plates to transfer onto both sides of a printing medium, the blanket cylinders having slightly different finished diameters from that of the plate cylinders, and a drive gear train for driving the plate cylinders and the blanket cylinders in synchronism with each other with maintaining desired phase relationship therebetween, the drive gear train establishing a path for power transmission so that the driving power is first transmitted to one of the plate cylinders and the blanket cylinders having smaller finished diameter and subsequently to the other.

1 Claim, 3 Drawing Sheets

BLANKET TO BLANKET TYPE PRINTING PRESS EMPLOYING DIVIDED PLATE CYLINDER

BACKGROUND OF THE INVENTION

1. Field of the Invention

The present invention relates generally to a blanket-to-blanket type (hereafter BB-type) printing press. More specifically, the invention relates to a BB-type printing press with a divided plate cylinder, having independently adjustable rotational phases of the divided plate cylinder components.

2. Description of the Related Art

The BB-type printing press generally comprises a pair of blanket cylinders respectively coupled with plate cylinders. The blanket cylinders are arranged in juxtaposition for movement toward and aft from each other. The pair of blanket cylinders defines there between a path for feeding a web paper to pass therethrough. While the web paper travels through the path defined by the pair of blanket cylinders, printing is performed on both sides of the web paper.

On the other hand, it is known in the prior art to employ a divided plate cylinder for the BB-type printing press. The divided plate cylinder includes two plate cylinder components separated from each other in an axial direction. These plate cylinder components independently adjusted for relative angular phase therebetween.

A rotation in an associated rotating condition means the following phenomenon caused on the periphery of a driven side cylinder when the plate cylinder carrying one or more printing plates thereon and the blanket cylinder mounting a blanket on the periphery thereof are arranged in side-by-side juxtaposed relationship and driven by a gear train with the identical pitch circle diameters and identical number of gear teeth for rotation at the same speed in the opposite direction, and when the finishing diameter of the cylinder at the driving side is set greater than that of the driven side. Namely, with the contact pressure exerted by the periphery of the cylinder at the driving side, the peripheral speed of the driven side cylinder tends to rotate at the same rotation speed to the driving side cylinder. In other words, the rotational phase of the driven side cylinder is offset following to the rotational phase of the driving side cylinder within a tolerance range of phase shift due to backlash in the gear train, in the range of which the driving force transmitted through the gear train is not effective and thus cannot be externally controlled. In such condition, since the driven side cylinder is caused free angular displacement relative to the driving side cylinder, the contact phase of the cylinders may fluctuate depending upon temporary variation of contact pressure on the contacting peripheries of the cylinders. This makes is uncertain to establish desired phase relationship between the driving side cylinder and the driven side cylinder and rather permits offset within the angular range of the backlash of the gear train.

On the other hand, for high quality and clear printing, it is essential to establish precisely constant position of transferring printing pattern from the printing plate or plates on the plate cylinder to the blanket cylinder. The rotation in an associated rotating condition caused between the plate cylinder and the blanket cylinder may not be synchronized in rotational phases of the plate cylinder and the blanket cylinder to cause register error to degrade quality of printing pattern. Typically, fluctuation of the relative rotational phase between the plate cylinder and the blanket cylinder is reflected by lowering of sharpness of the printed pattern and by doubling of the printed pattern in the worst case.

Slightly differentiating the finishing diameter of the plate cylinder, on which the printing plate or plates are mounted and the finishing diameter of the blanket cylinder, on which the blanket is mounted, has been known in an equal diameter cylinder arrangement, a true-rolling cylinder arrangement and so forth.

Japanese Unexamined Patent Publication (Kokai) 61-182951 proposes a technology for preventing rotation in the associated rotating condition in BB-type printing press employing a normal, integral plate cylinder. Although the shown technology may be effective for prevention of the rotation in the associated rotating condition as long as the plate cylinder is not separated into two components, a difficulty i encountered in prevention of the rotation in the associated rotating condition in case of the divided plate cylinder. For facilitating understanding of the present invention, brief discussion will be given herebelow about the difficulty in prevention of the rotation in the associated rotating condition caused in the prior art with reference to FIG. 5.

FIG. 5 shows a plan view of the BB-type printing press in the prior art, which employs a driving means. The shown example is directed to the BB-type printing press construction, in which a pair of divided plate cylinders 1 and 1' are employed. Respective of the divided plate cylinder 1 and 1' includes main body side plate cylinder 1*a* and 1*a'* and divided cylindrical plate cylinder 1*b* and 1*b''*. A pair of blanket cylinders 2 and 2' are arranged in juxtaposition to respectively associated divided plate cylinders 1 and 1' and to each other. The blanket cylinders 2 and 2' are supported on a drive side frame 3 and an operation side frame 4 in movable fashion for movement toward and aft from each other. The pair of blanket cylinders 2 and 2' are provided with finished diameters slightly greater than the finished diameters of the pair of divided plate cylinders 1 and 1' (1*a* and 1*b*, and 1*a''* and 1*b''*).

In the construction of FIG. 5, the drive means is constructed as follow. At first, an intermediate gear 5 connected to a driving power source is engaged to a transfer gear 6 mounted on the end of a shaft of the main body side plate cylinder 1*a*. The transfer gear 6 is meshed with a transfer gear 7 mounted on the end of a shaft of the blanket cylinder 2. Through the gear train set forth above, the driving torque from the driving power source is transmitted to the transfer gears 6 and 7 for driving the main body side plate cylinder 1*a* and the blanket cylinder 2 in mutually opposite directions. With the shown path of driving torque transmission, since the main body side plate cylinder 1*a* having smaller diameter is positioned upstream side of the blanket cylinder 2 which has the greater diameter, no rotation in the associated rotating condition can be caused.

Then, the transfer gear 7 mounted on the end of the shaft of the blanket cylinder 2 is meshed with an intermediate gear 8 which is rotatably supported on the end of a shaft of the blanket cylinder 2' for free rotation relative thereto. The intermediate gear 8 meshes with a transfer gear 9 mounted on the end of a shaft of the main body side plate cylinder 1*a'* on the opposite side. The transfer gear 9 meshes with a driven gear 10 which is mounted on the end of a cylinder shaft of the blanket cylinder 2'. Therefore, the main body side plate cylinder 1a' and the blanket cylinder 2' are also driven to rotate in mutually opposite directions in synchronism with rotation of the main body side plate cylinder 1a and the blanket cylinder 2. Similarly to the above, in the power transmission path set forth above, since the main body side plate cylinder 1a'' having the smaller diameter is the greater diameter. Therefore, no rotation in the associated rotating condition can be occurred.

On the other hand, driven gears 12 and 14 of the divided body side plate cylinders 1b and 1b' are engaged to transfer gears 11 and 13 respectively mounted on the opposite ends of the shafts of the blanket cylinders 2 and 2'. The transfer gears 11 and 13 are driven to rotate together with the blanket cylinders 2 and 2' when the latter are driven by the driving torque transmitted through the drive side gear train as set forth above. The rotational torque on the transfer gears 11 and 13 is thus transmitted to the driven gears 12 and 14 to rotatingly drive the divided body side plate cylinders 1b and 1b'. As can be appreciated, in the shown driving power transmission path at the operation side, the blanket cylinders 2 and 2' having greater diameters are located upstream side of the divided body side plate cylinders 1b and 1b' having smaller diameter. Therefore, rotation in the associated rotating condition may be caused on the divided body side plate cylinders 1b and 1b' to lower sharpness of the printed pattern and to cause doubling of the printed pattern in the worst case.

SUMMARY OF THE INVENTION

In view of the drawback in the prior art, it is an object of the present invention to provide a novel drive train for a BB-type printing press employing a divided plate cylinder for avoiding rotation in the associated rotating condition and whereby to maintain satisfactory level of sharpness and/or clearness of printed patterns.

In order to accomplish above-mentioned and other objects, a blanket-to-blanket type printing press comprises:

a pair of plate cylinders respectively carrying printing plates, each of the plate cylinders being separated into axially aligned first plate cylinder component and second plate cylinder component for rotation at independently adjustable rotational phases;

a pair of blanket cylinders respectively carrying blankets and associated with the plate cylinders for receiving printing pattern of the printing plates to transfer onto both sides of a printing medium, the blanket cylinders having slightly different finished diameters from that of the plate cylinders; and a drive gear train for driving the plate cylinders and the blanket cylinders in synchronism with each other with maintaining desired phase relationship therebetween, the drive gear train establishing a path for power transmission so that the driving power is initially transmitted to said cylinders having smaller finished diameter and subsequently to the other cylinders having greater finished diameter.

In the foregoing construction, when the pair of blanket cylinders ar provided slightly smaller finished diameter than that of the plate cylinders, the driving power transmission path is established so that the driving power is initially transmitted to the blanket cylinder and then transmitted to the first plate cylinder components at a first axial end portion and to the second plate cylinder components at a second axial end portion opposite to the first axial end portion.

In such case, the drive gear train may comprise:

a pair of first transfer gears rigidly mounted on respective of first axial ends of shafts of the blanket cylinders and engaged with each other;

a pair of second transfer gears rigidly mounted on respective of first axial ends of shafts of the blanket cylinders;

a pair of first driven gears rigidly mounted on respective of first axial ends of shafts of the first plate cylinder components, and engaged with the first transfer gears respectively;

a pair of second driven gears rigidly mounted on respective of second axial ends of shafts of the second plate cylinder components, and engaged with the second transfer gears respectively;

an intermediate gear engaged with one of the first transfer gears;

the driving power transmission path being established by connecting one of the first transfer gears to a driving power source through the intermediate gear, transferring driving torque on the one of first transfer gears to one of the first driven gears and to the other of the transfer gear, transferring driving torque on the other of the first transfer gears to the other of the first driven gears, transmitting driving toque on the both of the first transfer gears to the second transfer gears through the shafts of the blanket cylinders, and transferring the driving torque on the second transfer gears to respective of the second driven gears.

Alternatively, when the blanket cylinders are provided slightly greater finished diameter than that of the plate cylinders, the driving power transmission path is established so that the driving power is initially provided for the first plate cylinder components, and then transferred to the second plate cylinder components through the shafts of the plate cylinders and to the blanket cylinders.

In this case, the drive gear train may comprise:

a pair of first transfer gears rigidly mounted on respective of first axial ends of the shafts of the first plate cylinder components;

a pair of second transfer gears rigidly mounted on respective of second axial ends of the shafts of the first plate cylinder components;

a pair of first driven gears rigidly mounted on respective of first axial ends of the shafts of the blanket cylinders, and engaged with the first transfer gears respectively;

a pair of second driven gears rigidly mounted on respective of second axial ends of the shafts of the second plate cylinder components, and engaged with the second transfer gears respectively;

an intermediate gear engaged with one of the first transfer gears and also engaged with one of the first driven gears; and the driving power transmission path being established by supplying driving torque of a driving power source to one of the first transfer gears, transferring the driving torque on the one of the first transfer gears to one of the first driven gears and to one of the second transfer gears through the shaft of one of the first plate cylinder components, transferring the driving torque on the one of the first driven gears to the other of the first transfer gears through the intermediate gear, transferring the driving torque on the other of the first transfer gears to the other of the first driven gears and to the other of the second transfer gears through the shaft of the other first plate cylinder components, and transferring driving torque on respective of the second transfer gears to respective of the second driven gears.

In the preferred construction, one of the second transfer gear and the second driven gear is an external gear and the other of the second transfer gear and the second driven gear is an internal gear.

In the alternative, when the blanket cylinders are provided slightly greater finished diameter than that of the plate cylinders, the drive gear train may comprise:

first pair of transfer gears rigidly mounted on respective of the first axial ends of shafts of the first plate cylinder components;

a second transfer gear rigidly mounted on the second axial end of shaft of one of the second plate cylinder components;

first pair of driven gears rigidly mounted on respective of first axial ends of shafts of the blanket cylinders;

second pair of driven gears rigidly mounted on respective of second axial ends of shaft of the blanket cylinders;

a third driven gear rigidly mounted on second axial end of the shaft of the other of the second plate cylinder components;

an intermediate gear engaged with one of the first pair of the driven gears and also engaged with the other of the first pair of the transfer gears; and the driving power transmission path includes a first path being established at the first axial end portion by connecting one of the first transfer gears to a driving power source, transferring driving torque on the one of first transfer gears to one of the driven gears, transferring driving torque on the one of the driven gears to the other of the first transfer gears through the first intermediate gear, transferring driving torque on the other of the first transfer gears to the other of the driven gears, and a second path established at the second axial end portion by connecting the second transfer gears to the driving power source, transmitting driving torque on the other of the second transfer gears to the third driven gear through the second pair of driven gears.

BRIEF DESCRIPTION OF THE DRAWINGS

The present invention will be understood more fully from the detailed description given herebelow and from the accompanying drawings of the preferred embodiment, which, however, should not be taken to limitative to the invention, but are for explanation and understanding only.

In the drawings.

DESCRIPTION OF THE PREFERRED EMBODIMENT

Figure 1:
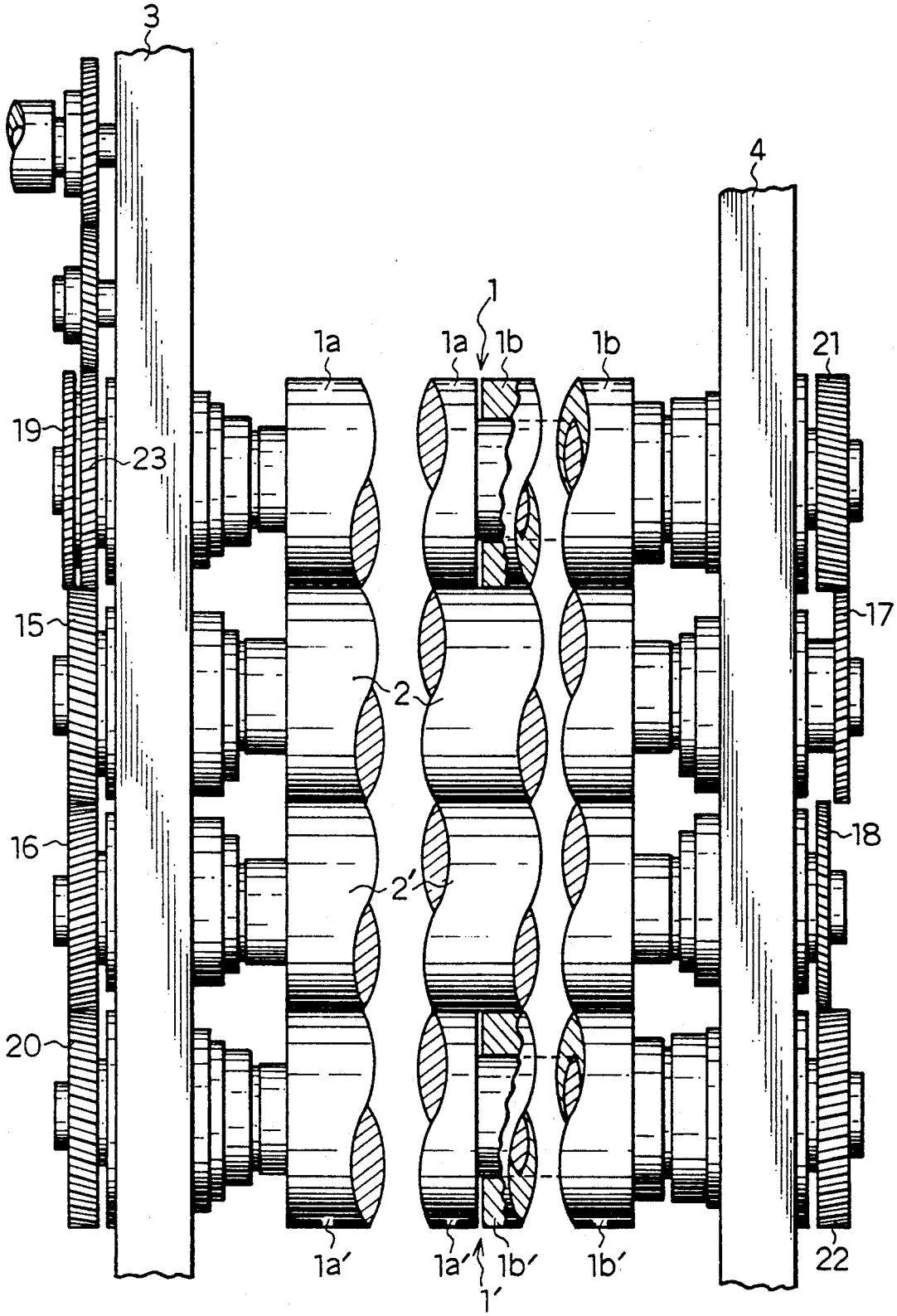
FIG. 1 is a partial plan view of the first embodiment of a BB-type printing press according to the present invention, which employs divided plate cylinders.

Referring now to the drawings, particularly to FIG. 1, there is illustrated a plan view of the major part of the first embodiment of the BB-type printing press. A pair of divided plate cylinders 1 and 1' respectively including main body side plate cylinders 1*a* and 1*a'* and divided cylindrical plate cylinders 1*b* and 1*b'*, and a pair of blanket cylinders 2 and 2' are arranged in juxtaposition between a drive side frame 3 and an operation side frame 4. The pair of blanket cylinders 2 and 2' are arranged for movement toward and aft from each other so that they may contact and release from a web paper as a printing medium, fed therebetween. Although it is not illustrated on the drawings, respective plate cylinders 1 and 1' are associated with ink arrangements and damping arrangements which may be arranged in per se well known manner.

In the shown embodiment, the finished diameters of the pair of blanket cylinders 2 and 2' are slightly smaller than the finished diameters of the plate cylinders 1 and 1'.

For the shown arrangement of the plate cylinders 1 and 1' (main body side plate cylinders 1*a* and 1*a'* and divided cylindrical plate cylinders 1*b* and 1*b'*) and the blanket cylinders 2 and 2', a drive gear train is established in the following manner. At first, for both axial ends of shafts of the blanket cylinders 2 and 2', transfer gears 15, 16, 17 and 18 are rigidly mounted. For the axial ends of shafts of the main body side plate cylinders 1*a* and 1*a'*, driven gears 19 and 20 are rigidly mounted. On the other hand, for the axial ends of the shafts of the divided cylindrical plate cylinders b and b', driven gears 21 and 22 are rigidly mounted. The transfer gears 15 and 16 on the drive side ends of the shafts of the blanket cylinders 2 and 2' are meshed to each other for transmitting the driving torque therebetween. One of the transfer gears 15 and 16 (the transfer gear 15 in the shown case) is drivingly coupled with an intermediate gear 23 which is connected to a driving power source to be driven by the driving torque therefrom. In the shown construction, the intermediate gear 23 is rotatably mounted on the shaft of the main body side cylinder 1*a* commonly with the driven gear 19, for free rotation relative thereto. The driven gears 19 and 20 are respectively engaged with the transfer gears 15 and 16 of the blanket cylinders 2 and 2'. On the other hand, the transfer gears 17 and 18 of the blanket cylinders 2 and 2' are engaged with the driven gears 21 and 22 of the divided cylindrical plate cylinders 1*b* and 1*b'*.

With the shown power transmission layout, since the plate cylinders 1*a*, 1*a'* and 1*b*, 1*b'* having slightly greater diameters than the blanket cylinders 2 and 2' downstream of the latter with respect to the established power transmission path. Therefore, no rotation in the associated rotating condition can be caused in the blanket cylinders 2 and 2'. Therefore, relative rotational phase offset between the plate cylinder and the blanket cylinder, which phase offset is caused otherwise to degrade sharpness or clearness of the printed image or to cause doubling of printed image, can be successfully avoided to maintain high quality of the prints.

Figure 2:
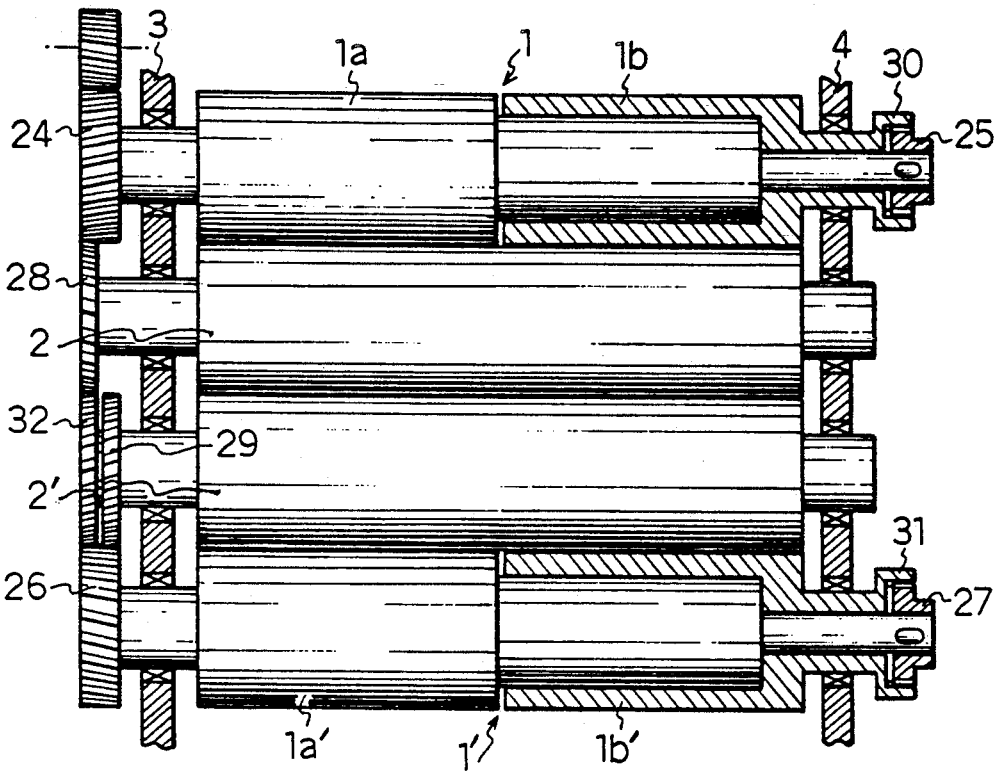
FIG. 2 is a diagrammatic plan view of the second embodiment of a BB-type printing press according to the present invention.
Figure 3:
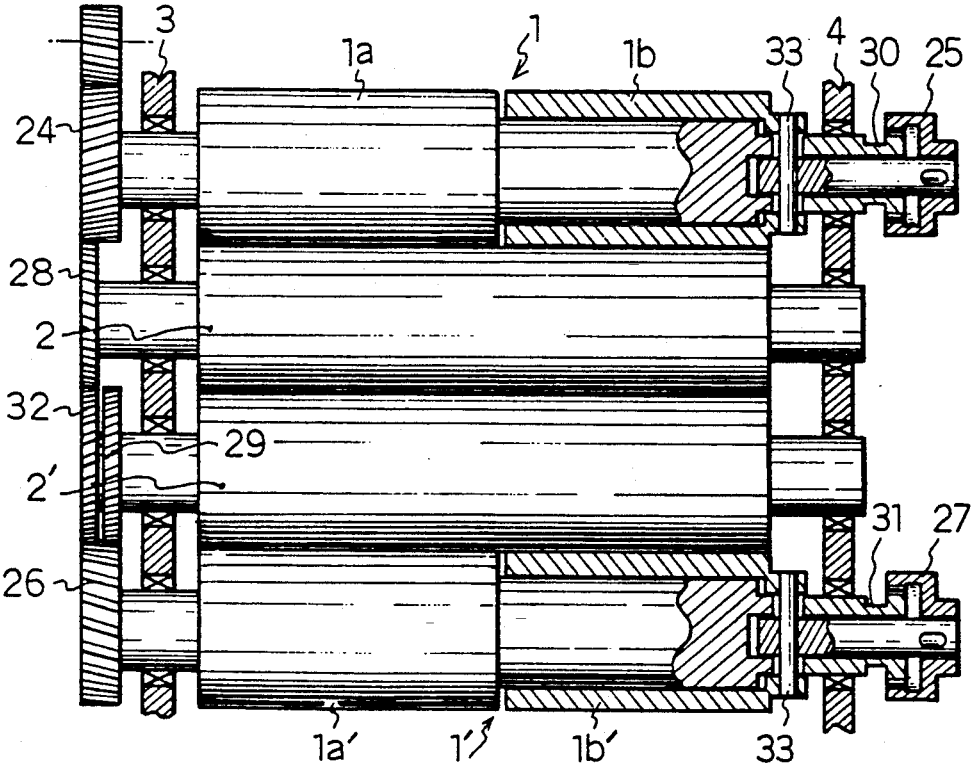
FIG. 3 is a diagrammatic plan view of the third embodiment of a BB-type printing press according to the present invention.

FIGS. 2 and 3 respectively shows the second and third embodiments of the BB-type printing presses, according to the present invention. In these embodiments, the pairs of blanket cylinders 2 and 2' are provided slightly greater finished diameter than those of the divided plate cylinders 1 and 1', contrary to the first embodiment.

In the construction shown in FIGS. 2 and 3, transfer gears 24, 25, 26 and 27 are rigidly mounted on both axial ends of shafts of the main body side plate cylinders 1*a* and 1*a'*. Driven gears 28 and 29 are respective mounted on the drive side axial ends of the shafts of the blanket cylinders 2 and 2'. Also, the internal driven gears 30 and 31 are mounted on the shafts of the divided cylindrical plate cylinders 1*b* and 1*b'*. The transfer gear 24 of the main body side plate cylinder 1*a* is connected to a driving power source (not shown) and meshed with the driven gear 28 of the blanket cylinder 2. The driven gear 28 is, in turn, meshed with an intermediate gear 32 which is rotatably mounted on the drive side axial end of the shaft of the blanket cylinder 2' in common with the driven gear 29 but is rotatable relative to the shaft. The intermediate gear 32 is meshed with the transfer gear 26 of the main body side plate cylinder 1*a'*. The transfer gear 26 is, in turn, meshed with the driven gear 29 of the blanket cylinder 2'. On the other hand, the transfer gears 25 and 27 on the operation side axial ends of the shafts of the main body side plate cylinder 1*a* and 1*a'* are meshed with internal driven gears 30 and 31 of the divided cylindrical plate cylinders 1*b* and 1*b'*.

The foregoing drive gear train construction is common to both of the second and third embodiments. The third embodiment of the BB-type printing press is differentiated from the second embodiment, in that the internal driven gears 30 and 31 in the second embodiment are replaced with external driven gears 30' and 31', and the transfer gears 25 and 27 in the form of the external gears are replaced with internal transfer gears 25' and 27'. Also, in the construction of FIG. 3, the divided cylindrical plate cylinders 1*b* and 1*b'* and their shafts are formed separately and connected by means of connecting pins 33 for rotation together.

In the shown construction, since the blanket cylinders 2 and 2' having the larger diameters are located at the driven side (downstream in the driving torque transmission path) relative to the plate cylinders 1 and 1' (1*a*, 1*a'*and 1*b*, 1*b'*) having smaller diameter. Therefore no rotation in the associated rotating condition can be caused on the plate cylinders.

Figure 4:
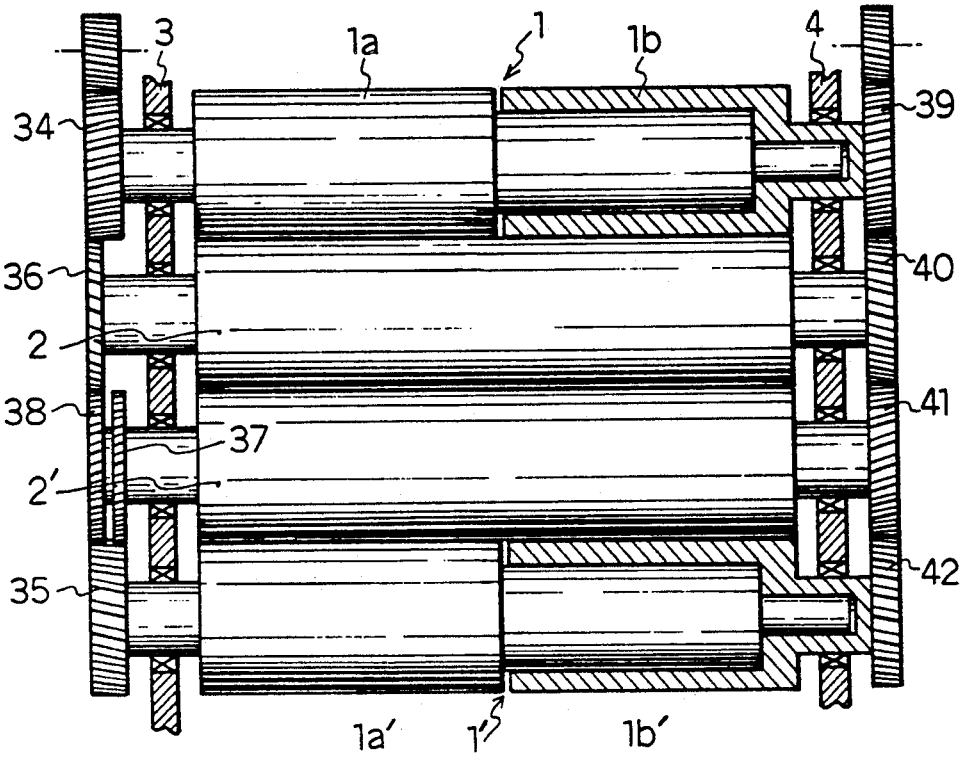
FIG. 4 is a diagrammatic plan view of the fourth embodiment of a BB-type printing press according to the present invention.
Figure 5:
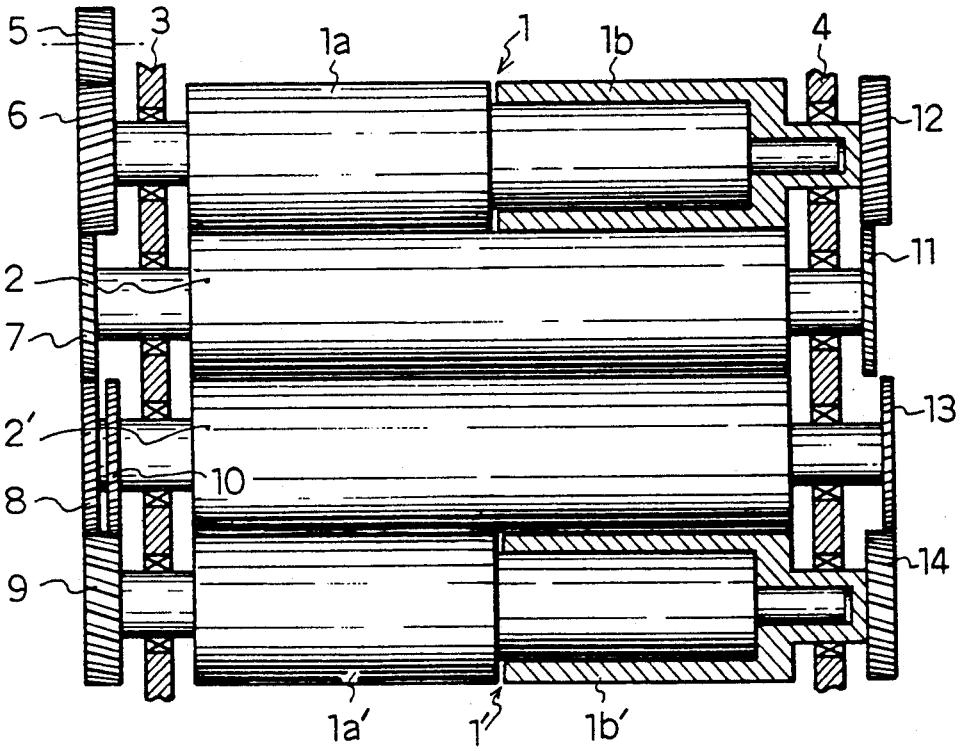
FIG. 5 (PRIOR ART)
FIG. 5 is a diagrammatic plan view of the conventional BB-type printing press.

FIG. 4 shows the fourth embodiment of the BB-type printing press, according to the present invention. In the shown embodiment, the blanket cylinders 2 and 2' are provided slightly greater finished diameters than the finished diameters of the o plate cylinders 1 and 1'.

The fourth embodiment of FIG. 4 is characterized by separate drive gear trains at the drive side and the operation side. The drive gear trains at respective of the drive side and the operation side independently transmit driving torque for respective of the main body side plate cylinders 1*a* and 1*a'*, the divided cylindrical plate cylinders 1*b* and 1*b'* an the blanket cylinders 2 and 2'.

The drive gear train at the drive side includes transfer gears 34 and 35 respectively mounted on the drive side axial ends of the shafts of the main body side plate cylinders 1*a* and 1*a'*. These transfer gears 34 and 35 are respectively meshed with driven gears 36 and 37 mounted on the drive side axial ends of shafts of the blanket cylinders 2 and 2'. An intermediate gear 38 is disposed between one of the transfer gears 34 and 35 (the transfer gear 35 in the shown case) and one of the driven gears 36 and 37 (the driven gear 36 in the shown case). In the shown arrangement, the transfer gear 34 is connected to the driving power source (not shown) to receive the driving torque therefrom. The intermediate gear 38 is rotatably mounted on the drive side axial end of the shaft of the blanket cylinder 2' in common to the driven gear 37. Therefore, the driving torque of the driven gear 36 is transferred to the transfer gear 35 of the main body side plate cylinder 1*a'*]via the intermediate gear 38 and then transferred to the driven gear 37 from the transfer gear 35. Therefore, similarly to the foregoing embodiments, the driving torque transmission path is established so that the driving torque is first transmitted to the main body side plate cylinders 1*a* and 1*a'* and then transmitted to the blanket cylinders 2 and 2'. As set forth with respect to the former embodiment, such drive train layout is successful in avoiding rotation in the associated rotating condition.

On the other hand, the operation side drive train includes a transfer gear 39 mounted on the operation side axial end of the shaft of the divided cylindrical plate cylinder 1*b*. The transfer gear 39 is connected to the driving power source (not shown) independently of the transfer gear 34 in the drive side. On the other hand, the transfer gear 39 is meshed with an intermediate gear 40 mounted on the operation side axial end of the blanket 2 for free rotation relative thereto. The intermediate gear 40 is, in turn, meshed with an intermediate gear 41 which is mounted on the operation side axial end of the shaft of the blanket cylinder 2' for free rotation relative thereto. The intermediate gear 41 is meshed with a driven gear 42 mounted on the operation side axial end of the shaft of the divided cylindrical plate cylinder 1*b'*. With the shown construction at the operation side, since the driving torque is active only for the divided cylindrical plate cylinders 1*b* and 1*b'* and not active on the blanket cylinders 2 and 2', the rotation in the associated rotating condition will never been caused.

As can be appreciated herefrom, according to the present invention, since the cylinders having smaller finished diameters than the other cylinders are located in the upstream position than the other cylinders, rotational driving torque is always supplied to the other and greater diameter cylinders through the smaller diameter cylinders. Therefore, rotation in the associated rotating condition will never caused. Therefore, rotational phase shift between the associated plate cylinder and blanket cylinder can be successfully eliminated to prevent occurrence of register error. Therefore, the printed pattern can be maintain in precise alignment and thus can maintain satisfactory level sharpness and clearness of the printed pattern.

It should be noted that present invention discussed in terms of the preferred embodiments, is applicable for multicolor printing press, such as for multicolor printing press for printing newspaper. Especially, the present invention is applicable for those multicolor printing disclosed in the co-pending Patent Applications filed on the same date to the present invention, which respectively entitled "Multicolor Printing Press" and "Multicolor Printing Press with Feature of Rotational Phase Adjustment", commonly assigned to the assignee of the present invention. The disclosures of the above-identified co-pending Patent Applications are also herein incorporated by reference.

While the present invention has been discussed in detail hereabove in terms of the preferred embodiment of the invention, the present invention can be embodied in various ways, with addition and omission and/or modification of the detailed parts of the shown embodiments without departing from the principle of the invention. Therefore, the present invention should be understood to include all possible embodiments and modifications thereof which can be implemented without departing from the invention as defined in the appended claims.

What is claimed is:

1. A blanket-to-blanket type printing press comprising:

a pair of plate cylinder and respective printing plates carried thereon, each of said plate cylinders being separated into axially aligned first plate cylinder component and second plate cylinder component for rotation at independently adjustable rotational phases;

a pair of blanket cylinders respectively carrying blankets and associated with said plate cylinders for receiving printing pattern of said printing plates to transfer onto both sides of a printing medium, said blanket cylinders having slightly different finished diameters from that of said plate cylinders; and a drive gear train for driving said plate cylinders and said blanket cylinders in synchronism with each other with maintaining desired phase relationship therebetween, said drive gear train establishing a path for power transmission so that the driving power is initially transmitted to said cylinders having smaller finished diameter and subsequently to the other cylinders having larger finished diameter, wherein said pair of blanket cylinders have slightly smaller finished diameter than larger finished diameter of said plate cylinders and wherein said drive gear train comprises:

respective shafts supporting said blanket cylinders a pair of engaged first transfer gears rigidly mounted on respective first axial ends of said shafts of said blanket cylinders;

a pair of engaged second transfer gears rigidly mounted on said respective first axial ends of said shafts of said blanket cylinders;

respective shafts supporting said first plate cylinder components;

a pair of first driven gears rigidly mounted on respective axial ends of said shafts of said first plate cylinder components, and said first driven gears engaged with the first transfer gears respectively;

respective shafts supporting said second plate cylinder components;

a pair of second driven gears rigidly mounted on respective axial ends of said shafts of said second plate cylinder components, and said second driven gears engaged with the second transfer gears respectively;

an intermediate gear connectable to a power source and engaged with one of the first transfer gears for delivery of driving torque thereto;

said driving power transmission path being established by, transferring driving torque on said one of said first transfer gears to one of said first drive gears and to the other of the transfer gears, transferring driving torque on said other of said first transfer gears to the other of said first driven gears transmitting driving torque on said both of the first transfer gears to the second transfer gears through the shafts of the blanket cylinders, and transferring the driving torque on the second transfer gears to respective of said second driven gears.

* * * * *

UNITED STATES PATENT AND TRADEMARK OFFICE

CERTIFICATE OF CORRECTION

PATENT NO. : 5,267,512

DATED : December 7, 1993

INVENTOR(S) : Masahiko Miyoshi, Kiyohisa Asanuma, Kazuharu Soutome

It is certified that error appears in the above-identified patent and that said Letters Patent is hereby corrected as shown below:

Column 2, Line 20 "i" should be — is —

Column 2, Line 34 "lb" " should be — lb' —

Column 3, Line 8 "la" " should be — la' —

Column 3, Line 8 " having the smaller diameter is the greater diameter " should be — having the smaller diameter is located on the upstream side of the blanket cylinder 2' having the greater diameter —

Column 3, Line 63 " ar " should be — are —

Column 7, Line 49 " the o plate " should be — the plate —

Signed and Sealed this

Twelfth Day of July, 1994

Bruce Lehman

*Attest:*

BRUCE LEHMAN

*Attesting Officer*

*Commissioner of Patents and Trademarks*